United States Patent [19]

Celms

[11] 4,122,955

[45] Oct. 31, 1978

[54] DISPLAY SHELVING

[75] Inventor: Harry Celms, Battle Creek, Mich.

[73] Assignee: Roblin Industries, Inc., Battle Creek, Mich.

[21] Appl. No.: 809,026

[22] Filed: Jun. 22, 1977

[51] Int. Cl.[2] ..... A47F 5/12

[52] U.S. Cl. ..... 211/126; 211/187; 108/108; 248/243

[58] Field of Search ..... 211/126, 90, 186, 187, 211/189, 190, 191, 192, 208, 175, 134; 108/106–108, 152; 248/241, 243

[56] References Cited

U.S. PATENT DOCUMENTS

| | | | |
|---|---|---|---|
| 2,891,678 | 6/1959 | Levy | 211/126 |
| 3,122,238 | 2/1964 | Brunette | 211/126 |
| 3,229,823 | 1/1966 | Hummer | 211/187 |
| 3,294,351 | 12/1966 | Rollins, Jr. | 248/243 |
| 3,495,718 | 2/1970 | Romero | 211/187 X |
| 3,701,325 | 10/1972 | Fenwick | 108/108 X |

*Primary Examiner*—Roy D. Frazier
*Assistant Examiner*—Terrell P. Lewis
*Attorney, Agent, or Firm*—Blanchard, Flynn, Thiel, Boutell & Tanis

[57] ABSTRACT

An upwardly opening shelf, preferably of wire construction, mountable on a pair of spaced uprights by a pair of brackets which coact between the opposite ends of the shelf and the adjacent uprights. The brackets are of an L-shaped configuration and include a first plate-like leg provided with a pair of vertically spaced hooks which engage spaced slots formed in the upright. The bracket has a second leg which extends substantially perpendicular to the hooked leg. This second leg comprises an enlarged substantially rectangular flat plate which is slidably supported on and confined by the rear wall of the shelf.

3 Claims, 8 Drawing Figures

DISPLAY SHELVING

FIELD OF THE INVENTION

This invention relates to display assemblies of the type which utilize basket-like containers or shelves removably mounted on vertical uprights and, in particular, to an improved bracket structure for mounting a shelf on a pair of uprights.

BACKGROUND OF THE INVENTION

Display type shelving structures are extensively utilized for retail merchandising, such as in supermarkets, which structures include elongated basket-like shelf units supported on and between a pair of spaced uprights. Removable dividers are optionally inserted into the shelf unit to divide same into a plurality of compartments. Since the uprights are normally not uniformly spaced apart, most conventional commercially available shelving structures have utilized mounting brackets which permit limited sideward displacement relative to the respective shelf so as to compensate for any irregularity in the spacing between the adjacent uprights. Shelving structures of this general type are illustrated by U.S. Pat. No. 3,229,823 and 3,495,718.

While shelving structures of this general type have operated in a generally satisfactory manner and have met with substantial commercial success, nevertheless these known structures have possessed structural and operational features which have been less than satisfactory. For example, many of these conventional shelving structures have the support brackets secured to the rear wall of the shelf by structure which, while it permits slidable displacement of the bracket, results in the bracket being securely attached and hence effectively nonremovable from the shelf. Because of this structure, the brackets must be securely attached to the shelf during manufacture thereof. This not only increases the complexity and hence the cost of the overall manufacturing operation, but also results in the bracket being of a complex structural shape, which in turn increases the manufacturing complexity and cost. This structure, wherein the bracket is secured to the shelf during assembly thereof, also descreases the flexibility of the shelf unit since interchanging of brackets so as to accommodate uprights or posts of different configurations, which interchanging operation must be done at the installation site, is thus a difficult and time consuming operation. A further disadvantage of the conventional structures is the complex shape of the bracket, which requires a multiple-step forming operation, requiring either several bending steps so as to permit the bracket to be formed from a single piece, or the formation of several preformed pieces which must then be fixedly assembled together.

Accordingly, it is an object of the present invention to provide an improved shelf-type display assembly, and particularly an improved bracket structure for mounting a basket-like shelf on a pair of spaced uprights, which improved structure and assembly overcome the above-mentioned disadvantages.

More specifically, it is an object of the present invention to provide an improved shelf unit, having a pair of slidable mounting brackets which are easily slidably accommodated on the back wall of the shelf and which are provided with hooks for engagement with the slotted uprights. These slidable brackets require no fixed association with the shelf and hence can be slidably mounted thereon during assembly of the shelf unit on the uprights. This greatly facilitates the on-site assembly and mounting of the shelf unit on the uprights and additionally permits efficient selection and interchanging of the brackets so as to be compatible with the slotted uprights without requiring any complex manipulations or reconstruction.

Another object of the present invention is to provide an improved mounting bracket, as aforesaid, which is of an L-shaped configuration and has one enlarged plate-like leg which is solely slidably supported on the shelf, and has a further smaller plate-like leg provided with suitable hooks for engagement with the slotted uprights, which legs extend substantially at right angles to one another. This mounting bracket is of minimum structural and constructional simplicity since it can be easily formed from a single piece of plate-like material, and the formation of the bracket involves a minimal number of forming operations, such as a single punching or cutting operation followed by a single bending operation.

The mounting bracket of the present invention, as aforesaid, is also advantageous in that this bracket, when assembled between the shelf and the slotted upright, is of minimum size and appears to be an integral part of the shelf, thereby creating no unsightly appearance. In addition, the L-shaped configuration of the bracket eliminates any projecting edges or corners. This bracket is also significantly more efficient and economical to manufacture, and permits improved efficiency in handling and assembling of the shelf unit.

Other objects and purposes of the invention will be apparent to persons familiar with structures of this type upon reading the following specification and inspecting the accompanying drawings.

Figure 1:
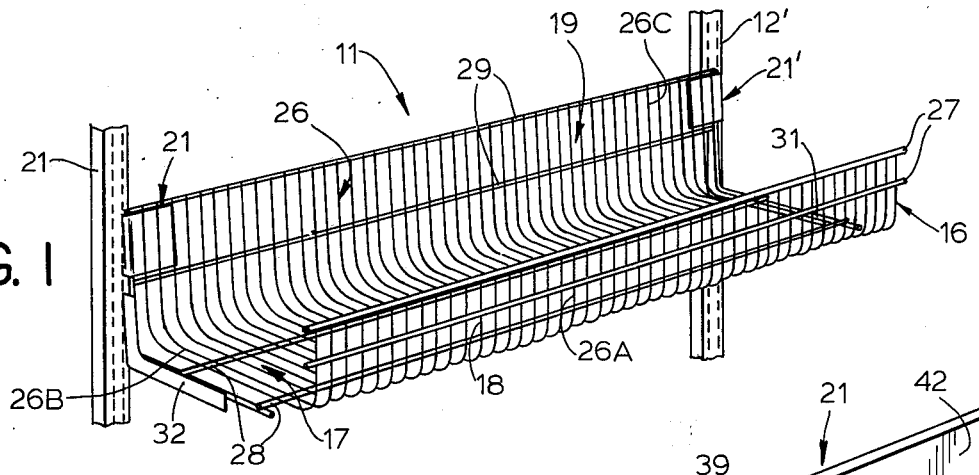
FIG. 1 is a fragmentary perspective view of a shelf unit according to the present invention.
Figure 2:
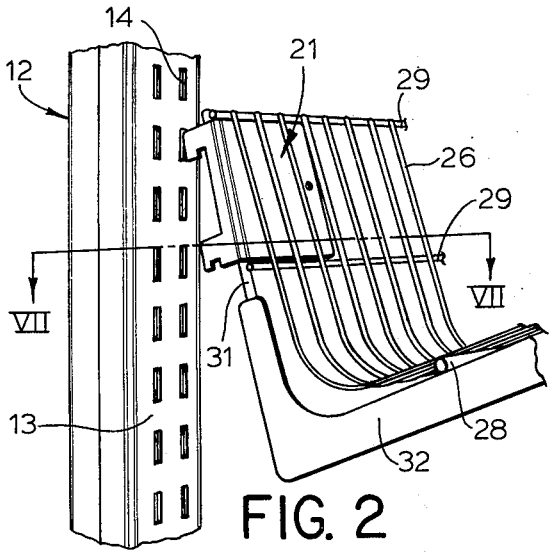
FIG. 2 is an enlargement of a portion of FIG. 1, the bracket and upright being illustrated in a disengaged relationship for clarity of illustration.
Figure 3:
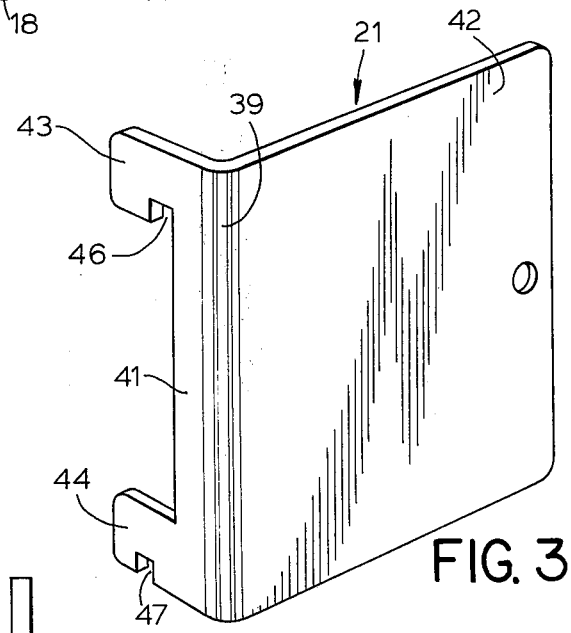
FIG. 3 is an enlarged perspective view of the mounting bracket.
Figure 4:
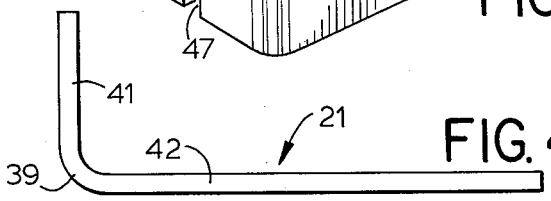
FIGS. 4, 5 and 6 are top, front and side views, respectively, of the bracket shown in FIG. 3.
Figure 5:
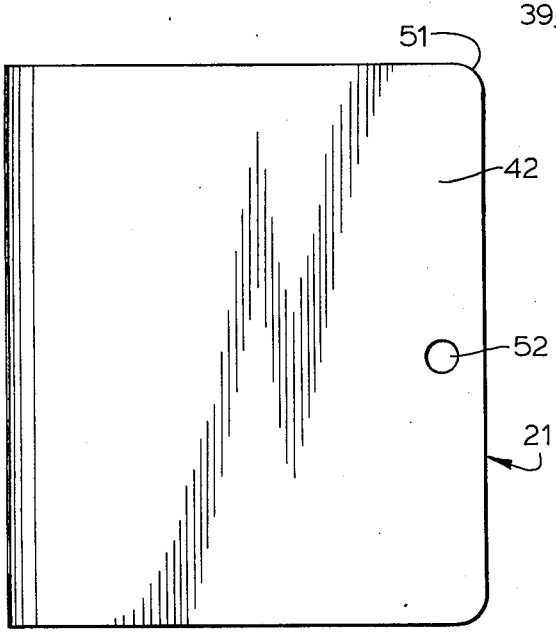

Certain terminology will be used in the following descriptions for convenience in reference only and will not be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the shelf unit and designated parts thereof. Said terminology will include the words specifically mentioned, derivatives thereof, and words of similar import.

SUMMARY OF THE INVENTION

The present invention comprises an upwardly opening shelf, preferably of wire construction, mountable on a pair of spaced slotted uprights by a pair of brackets which coact between the opposite corners of the shelf and the adjacent upright. The brackets are of an L-shaped configuration and includes a first plate-like leg provided with a pair of vertically spaced hooks which engage spaced slots formed in the upright. The bracket has a second leg which extends substantially perpendicular to the hooked leg. This second leg comprises an enlarged substantially rectangular plate which is slidably supported on and confined by the rear wall of the shelf. The shelf is formed from a plurality of horizontally adjacent crosswires which are of an upwardly opening channel-like shape. The rear vertical legs of the crosswires are fixedly joined together by a pair of vertically spaced, horizontally extending reinforcement rods. A pair of vertically extending retaining wires, or brackets, extend between and are fixedly welded to the rear sides of the reinforcing rods. The vertical legs of the crosswires and the retaining wires, or brackets, are thus secured to opposite sides of the reinforcing rods and define a narrow channel or space therebetween in which the second leg of said bracket is slidably confined. Said second leg has a vertical height which is substantially equal to but slightly less than the vertical spacing between the reinforcing rods so that said leg is closely confined therebetween, but can be horizontally slidably displaced to permit the bracket to be horizontally adjusted to properly engage with the adjacent upright. When the shelf is mounted on the uprights, the upper edge of the second leg bears against the upper reinforcing rod.

DETAILED DESCRIPTION

FIG. 1 illustrates a display assembly according to the present invention, which assembly includes a shelf unit 11 supported in a cantilever manner on a pair of identical vertically extending uprights 12 and 12'. As conventional, these uprights comprise channel or tube-like members which, in the front wall 13 thereof, are provided with rows of spaced elongated slots 14 for permitting several vertically spaced shelf units 11 to be mounted thereon.

The shelf unit 11 includes a substantially conventional wire shelf 16 which is of a channel or basket-shaped configuration, and includes a load supporting bottom wall 17 which terminates in upwardly projecting front and rear walls 18 and 19, respectively. This shelf 16 is supported in a cantilever fashion on the spaced uprights 12—12' by a pair of mounting brackets 21 and 21', which brackets are disposed adjacent the upper corners of the rear wall 19.

The wire structure forming the shelf 16 is substantially conventional in that the shelf is formed by a plurality of horizontally spaced, substantially parallel, upwardly opening channel-shaped crosswires 26. The front vertical legs 26A of these crosswires 26, which front legs 26A define the front wall 18, are rigidly joined together by a pair of horizontally extending and vertically spaced reinforcing bars 27. These bars are fixedly secured to the outer surfaces of the crosswires, as by being welded thereto, and the uppermost reinforcing bar 27 is positioned adjacent and effectively defines the free upper edge of the front wall. A further pair of larger reinforcing bars 28 are associated with the bottom wall 17, which bars 28 extend horizontally in substantially parallel relationship and extend perpendicularly with respect to the crosswires 26. These bars 28 are also fixed, as by being welded, to the undersurface of the horizontal center portions 26B of the crosswires 26.

The rear vertical legs 26C of the crosswires 26, which define the rear wall 19, are also fixedly joined together by a pair of horizonally extending, vertically spaced reinforcing bars 29. These latter bars are fixed (as by being welded) to the rear surfaces of the rear legs 26C. The uppermost reinforcing bar 29 is disposed so as to substantially define the uppermost free edge of the rear wall 19.

The opposite ends of the shelf 16 are provided with an L-shaped support rod 31 which has a horizontal leg portion extending under and fixedly secured to the bottom reinforcing rods 28, and a vertical leg portion extending rearwardly of and fixedly secured to the back reinforcing rods 29. The support rod 31 is further reinforced, as in the vicinity of its bight, by an L-shaped plate 32 which is fixedly secured to the rod 31, as by being welded thereto.

While not illustrated in the drawings, the shelf 16 is normally provided with removable wire-type dividers which can be positioned therein so as to either close off the ends of the shelf or divide same into a plurality of compartments if desired.

The construction of the shelf 16, as briefly described above, is conventional.

Figure 7:
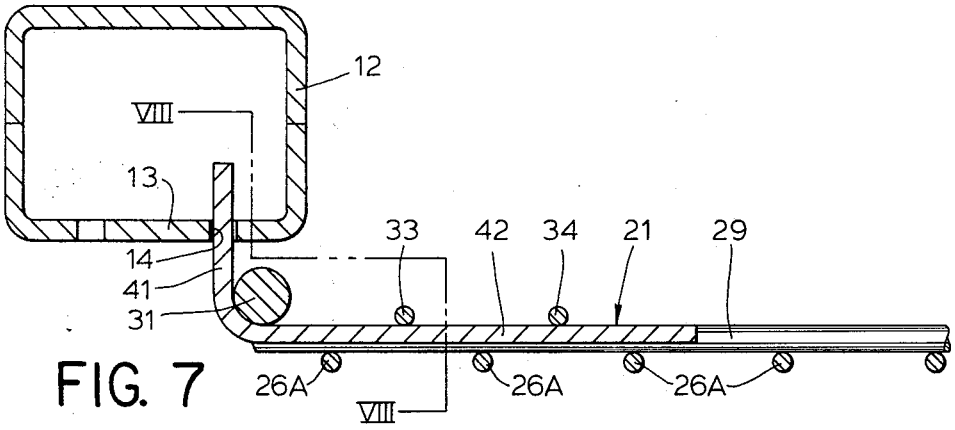
FIG. 7 is an enlarged, fragmentary sectional view taken along line VII—VII in FIG. 2, but showing the bracket engaged with the slotted upright.
Figure 8:
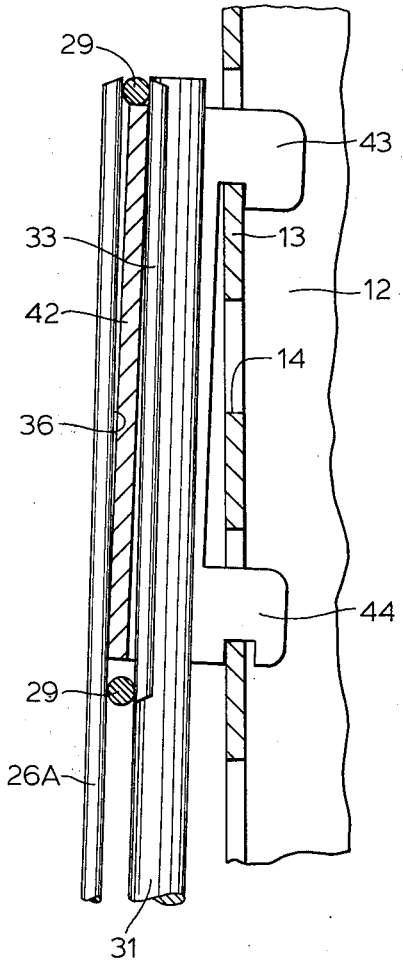
FIG. 8 is a fragmentary sectional view taken along line VIII—VIII in FIG. 7.

According to the present invention, the back wall 19 of shelf 16 is provided with a pair of horizontally spaced, vertically extending retainer wires 33 and 34 (FIGS. 7 and 8), or an equivalent bracket, disposed adjacent each of the upper corners thereof. These retainer wires, or brackets, are positioned rearwardly of and extend perpendicularly between the reinforcing rods 29. Retainer wires 33–34 are of a length similar to the vertical spacing between rods 29, and the upper lower ends of the retainer wires are suitably fixedly secured (as by being welded) to the rear surfaces of the upper and lower reinforcing rods 29, respectively. These retainer wires 33–34 thus extend in parallel with the rear vertical legs 26C, but have the reinforcing rods 29 positioned therebetween. The retainer wires, or brackets, as most clearly shown in FIG. 7, are positioned adjacent the end of the rear wall but are spaced inwardly a small distance from the vertical leg of the support rod 31. The retainer wires 33–34 and the crosswire legs 26C, and their cooperation and fixed attachment to the vertically spaced reinforcing rods 29, define therebetween a narrow guide channel 36 (FIG. 8) which is of substantial height (as defined between the reinforcing rods 29) and opens horizontally through the adjacent end of the shelf.

Considering now the mounting brackets 21 and 21', only the bracket 21 will be described inasmuch as the brackets are mirror images of one another.

The bracket 21, as illustrated in FIGS. 3–6 is of an L-shaped configuration and includes a pair of plate-like legs 41 and 42 which have their adjacent ends joined together by a rounded or bent corner 39. Each of the legs is of the same vertical height, which vertical height is substantially equal to but slightly less than the vertical spacing between the reinforcing rods 29.

The one leg 41 has upper and lower hooks 43 and 44, respectively projecting outwardly therefrom. These upper and lower hooks are, in the illustrated embodiment, provided with notches or recesses 46 and 47, respectively, which project upwardly from the lower edge of the respective hook. The hooks are of a substantially L-shaped configuration whereby they are adapted to project through the slot 14 and lockingly engage the front wall 13 of the upright, in a substantially conventional manner.

Figure 6:
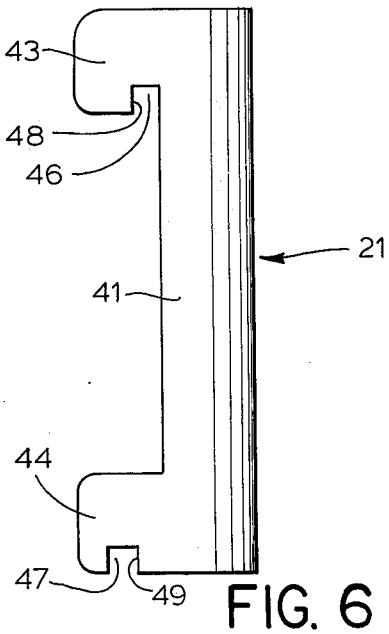

In the illustrated embodiment, the notches 46 and 47 are horizontally displaced such that the lower notch 47 is horizontally spaced a greater distance from the leg 42 than is the upper notch 46. This is shown in FIG. 6 which illustrates the rear sidewall 48 of the upper notch 46 being substantially vertically aligned with the front sidewall 49 of the lower notch 47. The purpose of this horizontal offset relationship between the notches 46 and 47 will be explained hereinafter.

The other leg 42 is formed as a substantially rectangular flat plate. This leg 42 has a length (as measured horizontally) which is of a magnitude similar to the height of the leg. For example, in the illustrated embodiment, the leg 42 has a vertical height of approximately 3½ inches, and the leg has a horizontal length of approximately 3 inches. This leg 42 is adapted to be horizontally slidably confined within the guide channel 36 defined within the back wall 19. The outer corners 51 at the free end of the leg 42 are preferably rounded to facilitate the sliding movement of the leg along the reinforcing rods 29. Leg 42 is also provided with an opening 52 extending therethrough adjacent the free edge thereof, which opening can be utilized for reception of a cotter pin or similar device if desired.

The mounting bracket 21, as is apparent from the configuration illustrated in FIGS. 3–6, is formed as an integral one-piece member and, due to its structural simplicity, is free of welds or similar structural connections. The bracket 21 can be efficiently and economically manufactured by being formed from a single piece of metal plate, which plate can be initially stamped or suitably cut so as to have the desired configuration, following which the formed plate can then be suitably bent so as to form the rounded corner 39, thereby resulting in the perpendicular relationship between the legs 41 and 42. The resulting mounting bracket thus possesses minimal structural complexity, and can be manufactured with substantially maximum economy. In addition, the bracket possesses the necessary strength and rigidity required for utilization with this type or display assembly.

OPERATION

The utilization of the shelf unit will be briefly described to insure a proper understanding thereof.

After manufacture of the shelf unit, same can be packaged and shipped with the mounting brackets 21—21' disassembled from the shelf 16 since the brackets, when assembled on the shelf, are solely slidably supported on the shelf. Hence, this assembly can best be carried out when the unit is being mounted on a pair of spaced uprights 12—12'. When such mounting of the shelf is desired, the installer slidably inserts the mounting brackets 21—21' into the guide channels 36 formed adjacent the opposite upper corners of the rear wall 19. The shelf with the mounting brackets thereon is then positioned adjacent the uprights 12—12' so as to span the distance therebetween. The hooks associated with one of the mounting brackets 21—21' are then inserted into the slots 14 associated with one upright, following which the hooks associated with the other mounting bracket are similarly inserted into the slots of the other upright. Since the horizontal spacing between the uprights 12—12' may be slightly greater or smaller than the recommended spacing, compensation is made for this variation merely by slidably displacing one or both brackets 21—21' relative to the shelf so that the spacing between the hooks on the brackets 21—21' thus equals the horizontal spacing between the slots of the spaced uprights.

When the shelf unit is mounted on the uprights, the horizontally offset relationship between the notches 46–47 results in the bottom wall 17 being initially tilted or sloped slightly upwardly away from the uprights. However, inasmuch as the shelf 16 undergoes a limited amount of elastic deformation when loaded, due to the cantilevered construction and support of the shelf, this offset relationship between the upper and lower hooks is sufficient to compensate for the downward deformation of the shelf when subjected to a normal load. The loaded shelf will thus elastically deflect downwardly and will assume a substantially horizontal position.

Since the mounting brackets 21—21' are not rigidly secured to the shelf 16, but are each connected thereto solely by the slidable confinement of the leg 42 within the guide channel 36, this not only facilitates the initial mounting of the shelf, but also permits the brackets to be readily interchanged when necessary so as to be compatible with the type of upright being utilized.

In some installations, it is desired that the mounting brackets be secured to the shelf when assembled on the uprights. Where such a securement is desired, this can be achieved by inserting a suitable stop element, such as a cotter pin, through the hole 52.

Although a particular preferred embodiment of the invention has been disclosed in detail for illustrative purposes, it will be recognized that variations or modifications of the disclosed apparatus, including the rearrangment of parts, lie within the scope of the present invention.

The embodiments of the invention in which an exclusive property or privilege is claimed are defined as follows:

1. In a shelf unit which extends between and is supported in a cantilever manner on a pair of horizontally spaced and vertically extending uprights having vertically spaced slots therein, said shelf unit including:

an upwardly opening basket-like shelf of wire rod construction and including back, bottom and front walls;

said shelf including a plurality of horizontally spaced and substantially parallel wire elements extending transversely thereof, each said wire element being of an upwardly opening channel-shaped configuration and including a front vertically extending leg portion forming a part of said front wall, a bottom substantially horizontal portion forming a part of said bottom wall, and a rear substantially vertically extending leg portion forming a part of said back wall;

each of said back, bottom and front walls have longitudinally extending reinforcing rods extending lengthwise of the respective wall in the lengthwise direction of the shelf, said reinforcing rods extending perpendicularly with respect to said wire elements and disposed adjacent the outer side of the respective wall, said reinforcing rods being fixed to the transversely extending wire elements at their points of engagement;

said plurality of reinforcing rods including first and second reinforcing rods fixedly associated with the back wall and disposed in vertically spaced relationship, said first reinforcing rod being spaced vertically upwardly a substantial distance above the second reinforcing rod and disposed adjacent the upper free edge of said back wall;

support means disposed adjacent each end of the shelf and fixedly connected to at least the back and bottom walls, said support means including a support rod extending transversely of the shelf and having a vertical leg portion fixed to the back wall and disposed rearwardly of the reinforcing rods and a horizontal leg portion fixed to the bottom wall, said support rod being engaged with and fixedly connected to the reinforcing rods associated with said bottom and back walls, said reinforcing rods of said bottom and back walls being sandwiched between said support rod and said transversely extending wire elements; and a pair of removable mounting brackets coacting between the opposite ends of said rear wall and said pair of spaced uprights for connecting said shelf to said uprights, each of said mounting brackets having a pair of vertically spaced, downwardly opening hooks associated therewith for engagement with the respective upright, comprising the improvement wherein:

at least one rod-like retainer wire is fixedly associated with said back wall adjacent each end thereof and spaced inwardly from the adjacent support rod, said retainer wire extending transversely between and being fixedly connected to said first and second reinforcing rods, said retainer wire being disposed rearwardly of said first and second reinforcing rods so as to engage some on the same side thereof as said support rod, whereby said first and second reinforcing rods are sandwiched between the transversely extending wire elements on one side thereof and the support rod and the retainer wire on the other side thereof, thereby defining a narrow but tall guide channel which extends horizontally and opens outwardly through the adjacent end of the back wall; and each said mounting bracket consisting solely of an L-shaped one-piece bracket member of integral construction and having first and second vertically planar plate-like flat legs which extend horizontally substantially at a right angle with respect to one another, said bracket member including said first and second legs having a vertical height which is only slightly less than the vertical spacing between said first and second reinforcing rods, said first leg being of relatively short horizontal length and having said hooks projecting outwardly therefrom for engagement with the slots formed in one of said uprights, said hooks being coplanar and integral with said first leg, said hooks also being positioned closely adjacent the upper and lower edges of said first leg so as to be vertically spaced a substantial distance apart, the second leg having a horizontal length which is substantially greater than the length of said first leg and which is at least of similar magnitude to the vertical height of the bracket member, said second leg being solely slidably engaged with said shelf and horizontally slidably confined within said narrow guide channel, said second leg when disposed within said narrow guide channel being closely confined on the front side thereof by the rear vertical leg portions of at least two of said wire elements and being closely confined on the rear side thereof by the vertical leg of said support rod and said rod-like retainer wire, whereby said second leg is solely slidably movable within said channel in the lengthwise direction of the back wall, and said second leg having a horizontally elongated upper edge disposed in slidable bearing engagement with the lower portion of the rounded outer peripheral surface of said first reinforcing rod when said shelf is supported in a cantilever manner on said uprights.

2. A shelf unit according to claim 1, wherein a pair of said rod-like retainer wires are disposed in spaced parallel relationship, said pair of rod-like retainer wires extending vertically and perpendicularly between and fixedly connected to said first and second reinforcing rods at the rearward sides thereof.

3. A shelf unit according to claim 2, wherein said pair of hooks includes upper and lower L-shaped hooks which project outwardly through equal distances from the free edge of said first leg, each of said L-shaped hooks defining an upwardly opening notch in the lower edge thereof, the notch in the upper hook being spaced outwardly from the junction of said first and second legs by a distance which is less than the spacing of the notch in the lower hook from said junction.

* * * * *

UNITED STATES PATENT AND TRADEMARK OFFICE

CERTIFICATE OF CORRECTION

PATENT NO. : 4 122 955

DATED : October 31, 1978

INVENTOR(S) : Harry Celms

It is certified that error appears in the above-identified patent and that said Letters Patent are hereby corrected as shown below:

Column 7, line 31; change "some" to ---same---.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*